US011679608B2

(12) United States Patent
Asada et al.

(10) Patent No.: US 11,679,608 B2
(45) Date of Patent: Jun. 20, 2023

(54) MOVING DEVICE, MOVING METHOD AND PRINTING APPARATUS

(71) Applicant: SCREEN HOLDINGS CO., LTD., Kyoto (JP)

(72) Inventors: Kazuhiko Asada, Kyoto (JP); Keisuke Hirai, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 17/469,074

(22) Filed: Sep. 8, 2021

(65) Prior Publication Data

US 2022/0080757 A1 Mar. 17, 2022

(30) Foreign Application Priority Data

Sep. 17, 2020 (JP) ..... JP2020-156277

(51) Int. Cl.
*B41J 25/00* (2006.01)

(52) U.S. Cl.
CPC ..... *B41J 25/001* (2013.01)

(58) Field of Classification Search
None
See application file for complete search history.

(56) References Cited

U.S. PATENT DOCUMENTS 4,804,285 A * 2/1989 Bradford ..... B41J 19/005 74/89.17
6,030,067 A 2/2000 Kawamura
6,585,347 B1 * 7/2003 Johnson ..... B41J 2/16517 347/29
2003/0076380 A1 * 4/2003 Yusef ..... B41J 19/005 347/37

FOREIGN PATENT DOCUMENTS

| | | | |
|---|---|---|---|
| EP | 2 974 869 | A1 | 1/2016 |
| JP | 2002-059568 | A | 2/2002 |
| JP | 2006-321239 | A | 11/2006 |
| JP | 2007-118545 | A | 5/2007 |
| JP | 2010-234771 | A | 10/2010 |
| JP | 2017-177362 | A | 10/2017 |

OTHER PUBLICATIONS

Extended European Search Report issued in corresponding European Patent Application No. 21191009.6-1017, dated Jan. 4, 2022.

* cited by examiner

*Primary Examiner* — Alejandro Valencia
(74) *Attorney, Agent, or Firm* — McDermott Will & Emery LLP

(57) ABSTRACT

Both end parts of a cord are fixed to a maintenance mounting frame, and an intermediate part of the cord is laid on a first body-side rotating member, a head-side rotating member and a second body-side rotating member. Here, when a motor is driven, the movement restriction of the cord is released and a movement of a head mounting frame is restricted, whereby only the maintenance mounting frame moves together with a maintenance part while the movement of the head mounting frame is restricted. Further, when the motor is driven, a movement of the cord is restricted and the movement restriction of the head mounting frame is released, whereby only the head mounting frame moves together with a discharge head while a movement of the maintenance part is restricted.

7 Claims, 6 Drawing Sheets

MOVING DEVICE, MOVING METHOD AND PRINTING APPARATUS

CROSS REFERENCE TO RELATED APPLICATION

The disclosure of Japanese Patent Application No. 2020-156277 filed on Sep. 17, 2020 including specification, drawings and claims is incorporated herein by reference in its entirety.

BACKGROUND OF THE INVENTION

1. Field of the Invention

This invention relates to a moving technique for alternatively moving a discharge head for printing by discharging an ink and a maintenance part for performing the maintenance of the discharge head.

2. Description of the Related Art

A printing apparatus is known which prints an image on the upper surface of a printing medium by discharging a water-based or oil-based ink from a discharge head in an ink-jet method. For example, in a printing apparatus described in JP 2017-177362A, a plurality of discharge heads are arrayed along a conveying direction of a printing medium. Each discharge head prints by discharging ink droplets to the upper surface of the printing medium from a nozzle surface. Thus, if deposits adhering to the nozzle surface are dried and fixed, the clogging of a nozzle occurs, leading to a reduction in printing performance. Accordingly, in JP 2017-177362A, a maintenance part for performing maintenance processings such as flushing and purging is provided at a retracted position. This retracted position is separated from a printing position where printing is performed in a horizontal direction orthogonal to the conveying direction. Thus, moving means for moving the discharge heads between the printing position and the retracted position is provided.

SUMMARY OF THE INVENTION

In the printing apparatus described in JP 2017-177362A, only the discharge heads are horizontally moved. In recent years, a printing apparatus has been proposed which horizontally moves a discharge head and a maintenance part independently of each other. That is, a horizontally moving mechanism for maintenance configured similarly to a mechanism for horizontally moving the discharge head is additionally installed, and the maintenance part is horizontally moved by this horizontally moving mechanism. However, in the proposed printing apparatus, two horizontally moving mechanisms are present side by side in a cross-section orthogonal to a conveying direction of a printing medium as described above although the discharge head and the maintenance part may be alternatively moved. This has caused a problem of leading to the enlargement of the apparatus and high cost.

This invention was developed in view of the above problem and aims to provide a technique capable of alternatively and easily moving a discharge head for printing by discharging an ink to a printing medium being conveyed in a first horizontal direction and a maintenance part for performing the maintenance of the discharge head in a second horizontal direction different from the first horizontal direction.

A first aspect of the invention is a moving device for alternatively moving a discharge head for printing by discharging an ink to a printing medium being conveyed in a first horizontal direction and a maintenance part for performing maintenance of the discharge head in a second horizontal direction different from the first horizontal direction, comprising: a body frame; a first body-side rotating member and a second body-side rotating member mounted rotatably on the body frame while being separated from each other in the second horizontal direction; a head mounting frame provided movably between the first body-side rotating member and the second body-side rotating member while mounting the discharge head; a maintenance mounting frame provided movably between the first body-side rotating member and the second body-side rotating member while mounting the maintenance part below the head mounting frame; a motor coupled to the head mounting frame; a head-side rotating member provided rotatably on the head mounting frame, the head-side rotating member rotating by receiving a rotational drive force of the motor; a cord having an intermediate part laid among the first body-side rotating member, the head-side rotating member and the second body-side rotating member, and both end parts of the cord being fixed to the maintenance mounting frame; a cord restriction switcher configured to switch movement restriction and movement restriction release of the cord; and a head restriction switcher configured to switch movement restriction and movement restriction release of the head mounting frame, wherein the maintenance mounting frame is moved together with the maintenance part by operating the motor while releasing the movement restriction of the cord and restricting a movement of the head mounting frame, and the head mounting frame is moved together with the discharge head by operating the motor while restricting a movement of the cord and releasing the movement restriction of the head mounting frame.

A second aspect of the invention is a moving method, comprising: operating a motor to alternatively perform a maintenance movement mode and a head movement mode with an intermediate part of a cord laid on a first body-side rotating member rotatably mounted on a body frame, a head-side rotating member rotatably provided on a head mounting frame for mounting a discharge head for printing by discharging an ink to a printing medium being conveyed in a first horizontal direction and a second body-side rotating member rotatably mounted on the body frame while being separated from the first body-side rotating member in a second horizontal direction different from the first horizontal direction and both end parts of the cord fixed to a maintenance mounting frame for mounting a maintenance part for performing maintenance of the discharge head, wherein the maintenance movement mode being performed such that a rotational drive force of the motor is given to the head-side rotating member to move the maintenance mounting frame together with the maintenance part while restricting a movement of the discharge head by operating the motor while releasing movement restriction of the cord and restricting a movement of the head mounting frame, and the head movement mode being performed such that the head mounting frame is moved together with the discharge head while restricting a movement of the maintenance part by operating the motor while restricting a movement of the cord and releasing movement restriction of the head mounting frame.

A third aspect of the invention is a printing apparatus, comprising: a discharge head configured to print by discharging an ink to a printing medium being conveyed in a first horizontal direction; a maintenance part configured to perform maintenance of the discharge head; and the moving device, the maintenance part is positioned in the second horizontal direction while the discharge head is fixedly arranged by operating the motor while releasing the movement restriction of the cord and restricting the movement of the head mounting frame, and the discharge head is positioned in the second horizontal direction while the maintenance part is fixedly arranged by operating the motor while restricting the movement of the cord and releasing the movement restriction of the head mounting frame.

In the invention thus configured, the both end parts of the cord are fixed to the maintenance mounting frame and the intermediate part of the cord is laid on the first body-side rotating member, the head-side rotating member and the second body-side rotating member. Here, when the motor is driven, the movement restriction of the cord is released and the movement of the head mounting frame is restricted, whereby only the maintenance mounting frame moves together with the maintenance part while the movement of the head mounting frame is restricted (maintenance movement mode). Further, when the motor is driven, the movement of the cord is restricted and the movement restriction of the head mounting frame is released, whereby only the head mounting frame moves together with the discharge head while the movement of the maintenance part is restricted (head movement mode).

As described above, the head mounting frame and the maintenance mounting frame can be alternatively moved by the single motor. That is, the discharge head for printing by discharging the ink to the printing medium being conveyed in the first horizontal direction and the maintenance part for performing the maintenance of the discharge head can be alternatively and easily moved in the second horizontal direction different from the first horizontal direction.

All of a plurality of constituent elements of each aspect of the invention described above are not essential and some of the plurality of constituent elements can be appropriately changed, deleted, replaced by other new constituent elements or have limited contents partially deleted in order to solve some or all of the aforementioned problems or to achieve some or all of effects described in this specification. Further, some or all of technical features included in one aspect of the invention described above can be combined with some or all of technical features included in another aspect of the invention described above to obtain one independent form of the invention in order to solve some or all of the aforementioned problems or to achieve some or all of the effects described in this specification.

DETAILED DESCRIPTION OF THE PREFERRED EMBODIMENTS

DETAILED DESCRIPTION OF THE PREFERRED EMBODIMENTS

Figure 1:
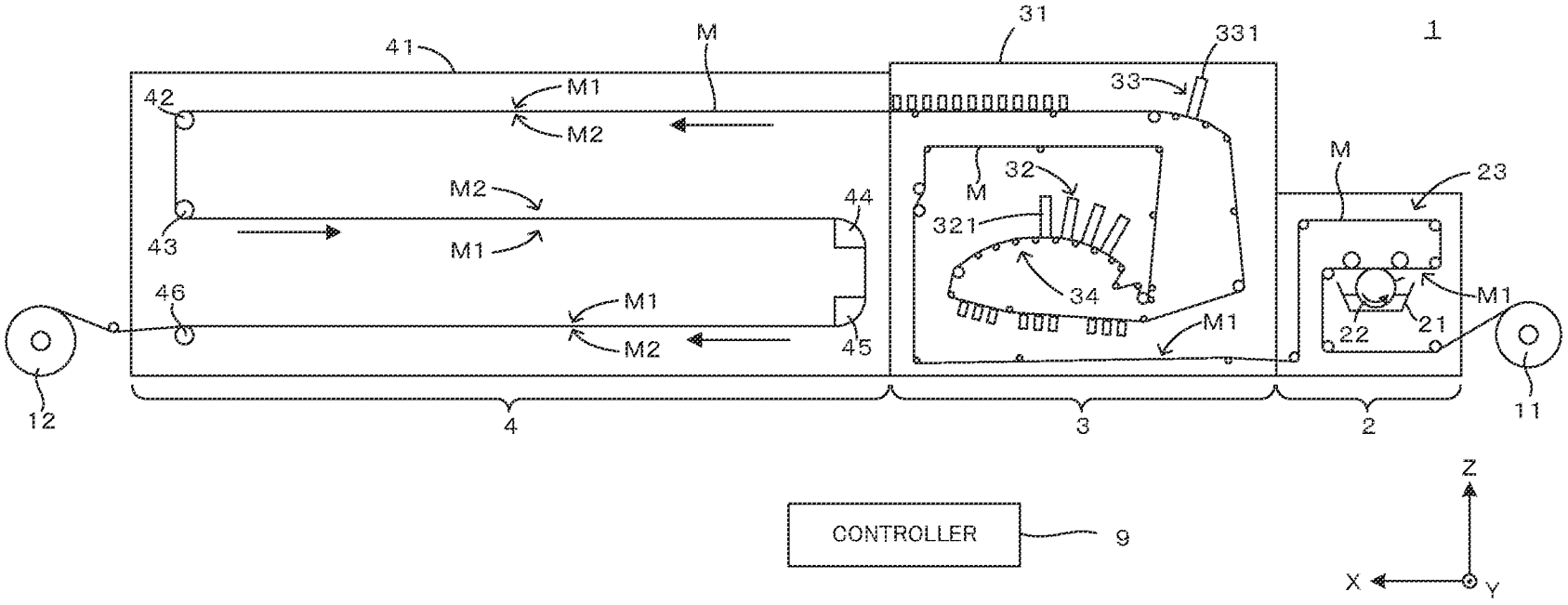
FIG. 1 is a front view schematically showing an example of a printing system according to the invention.

FIG. 1 is a front view schematically showing an example of a printing system according to the invention. In FIG. 1 and subsequent figures, a horizontal direction in which a coating apparatus 2, a printing apparatus 3 and a drying apparatus 4 constituting a printing system 1 are arranged is referred to as an "X direction", a horizontal direction from a right side toward a left side of FIG. 1 is referred to as a "+X direction" and an opposite direction is referred to as a "−X direction" to clarify an arrangement relationship of each component of the apparatus. Further, out of horizontal directions Y orthogonal to the X direction, a direction forward of the apparatuses is referred to as a "+Y direction" and a direction backward of the apparatuses is referred to as a "−Y direction". Further, upward and downward directions along a vertical direction Z are respectively referred to as a "+Z direction" and a "−Z direction".

This printing system 1 applies a coating process, a printing process and a drying process to a printing medium M while conveying the printing medium M in the form of a long strip from a feeding roll 11 to a winding roll 12 in a roll-to-roll manner by controlling each component of the apparatuses by a controller 9. That is, the coating apparatus 2 applies a coating liquid to the printing medium M. Then, the printing apparatus 3 prints an image by causing various inks to adhere to the printing medium M in an ink-jet method. Further, the drying apparatus 4 dries the inks adhering to the printing medium M. Note that a material of the printing medium M is a film made of OPP (oriented polypropylene), PET (polyethylene terephthalate) or the like. However, the material of the printing medium M is not limited to the film and may be paper or the like. Such a printing medium M is flexible. Further, out of both surfaces of the printing medium M, the surface on which images are to be printed is referred to as a front surface M1 and the surface opposite to the front surface M1 is referred to as a back surface M2 as appropriate.

The coating apparatus 2 includes a pan 21 storing a liquid primer (coating liquid), a gravure roller 22 partially immersed in the primer stored in the pan 21 and a conveying unit 23 conveying the printing medium M. In the coating apparatus 2, a coating region is provided where the gravure roller 22 contacts the printing medium M conveyed by the conveying unit 23 from below, and the conveying unit 23 conveys the printing medium M along the coating region with the front surface M1 of the printing medium M facing down. On the other hand, the gravure roller 22 supplies the primer to the coating region by rotating while holding the primer on the peripheral surface thereof. In this way, the primer supplied by the gravure roller 22 is applied to the front surface M1 of the printing medium M in the coating region. Further, in the coating region, a moving direction of the printing medium M and a rotating direction of the peripheral surface of the gravure roller 22 are opposite. That is, the primer is applied to the printing medium M by a reverse kiss method. Then, the conveying unit 23 carries out the printing medium M from the coating apparatus 2 to the printing apparatus 3 with the front surface M1 of the printing medium M having the primer applied thereto facing up.

The printing apparatus 3 includes a housing 31, a color printing unit 32 arranged in the housing 31, a white printing unit 33 arranged above the color printing unit 32 in the housing 31, and a conveying unit 34 conveying the printing medium M by a plurality of rollers arranged in the housing 31.

The color printing unit 32 includes a plurality of (four) discharge heads 321 arrayed in the moving direction (direction from the other side X2 toward the one side X1) of the printing medium M above the printing medium M conveyed by the conveying unit 34. The plurality of discharge heads 321 include nozzles facing the front surface M1 of the printing medium M passing therebelow from above, and discharge color inks of mutually different colors from the nozzles by the ink-jet method. Here, the color inks mean inks other than a white ink and include inks of cyan, magenta, yellow, black and the like. In this way, the plurality of discharge heads 321 of the color printing unit 32 print a color image on the front surface M1 of the printing medium M by discharging the color inks to the front surface M1 of the printing medium M passing therebelow from above.

Further, the white printing unit 33 includes a single discharge head 331 arranged above the printing medium M conveyed by the conveying unit 34. The discharge head 331 includes nozzles facing the front surface M1 of the printing medium M passing therebelow from above, and discharges the white ink from the nozzles by the ink-jet method. In this way, the discharge head 321 of the white printing unit 33 prints a white image on the front surface M1 of the printing medium M by discharging the white ink to the front surface M1 of the printing medium M passing therebelow from above.

Note that, although not shown in FIG. 1, two types of dryers are provided in the housing 31 of the printing apparatus 3. One dryer is a pre-dryer for drying the color inks adhered to the surface M1 of the printing medium M by the color printer 32. The other dryer is an upper dryer for drying the white ink adhered to the surface M1 of the printing medium M by the white printer 33.

Further, the color printer 32 and the white printer 33 discharge the inks from nozzle surfaces in the ink-jet method. Thus, if a printing process is performed for a long time, discharge failures of the nozzles gradually occur. Further, when printing is temporarily stopped, the inks adhering to the nozzle surfaces may be solidified to cause a discharge failure. Accordingly, a color maintenance part (35 in FIG. 2 to be described later) corresponding to the color printer 32 is provided. The color maintenance part is separated from the discharge heads 321 in the horizontal direction Y during normal printing. When the discharge heads 321 require maintenance, the color maintenance part moves to a position right below the discharge heads 321 to perform various types of maintenance. Then, the color maintenance part is separated from the discharge heads 321 in the horizontal direction Y after the end of the maintenance. These points similarly apply also to the white printer 33. That is, a white maintenance part (36 in FIG. 2 to be described later) corresponding to the white printer 33 is provided away from the discharge head 331 in the horizontal direction Y. During maintenance, the white maintenance part moves to a position right below the discharge head 331 to perform various types of maintenance and is, thereafter, separated from the discharge head 331 in the horizontal direction Y.

Further, as described in JP 2017-177362A, an operator may operate the nozzle surfaces of the discharge heads 321, 331 by directly accessing these. Thus, in the printing apparatus 3, the color printer 32 and the white printer 33 are movable in the horizontal direction Y. When an access of the operator becomes necessary, the color printer 32 and the white printer 33 are moved to retracted positions separated from printing positions in the horizontal direction Y.

As just described, in the printing apparatus 3, a horizontally moving mechanism is provided to move the color printer 32 and the color maintenance part in the Y direction. Further, a horizontally moving mechanism is provided to move the white printer 33 and the white maintenance part in the Y direction. These horizontally moving mechanisms correspond to examples of a "moving device" of the invention and are described in detail later.

The drying apparatus 4 dries the inks adhering to the surface M1 of the printing medium M being conveyed from the printing apparatus 3. The drying apparatus 4 includes a housing 41 (drying furnace). Further, in the housing 41, rollers 42, 43 and 46 are arranged on a (+X) side and air turn bars 44, 45 are arranged on a (−X) side. By this arrangement, a substantially S-shaped conveyance path when viewed from a (+Y) side is configured, and the printing medium M is conveyed along this conveyance path. The inks adhering to the surface M1 of the printing medium M are dried during this conveyance. Then, the printing medium M subjected to the drying process is carried out from the drying apparatus 4 and wound on the winding roll 12.

Figure 2:
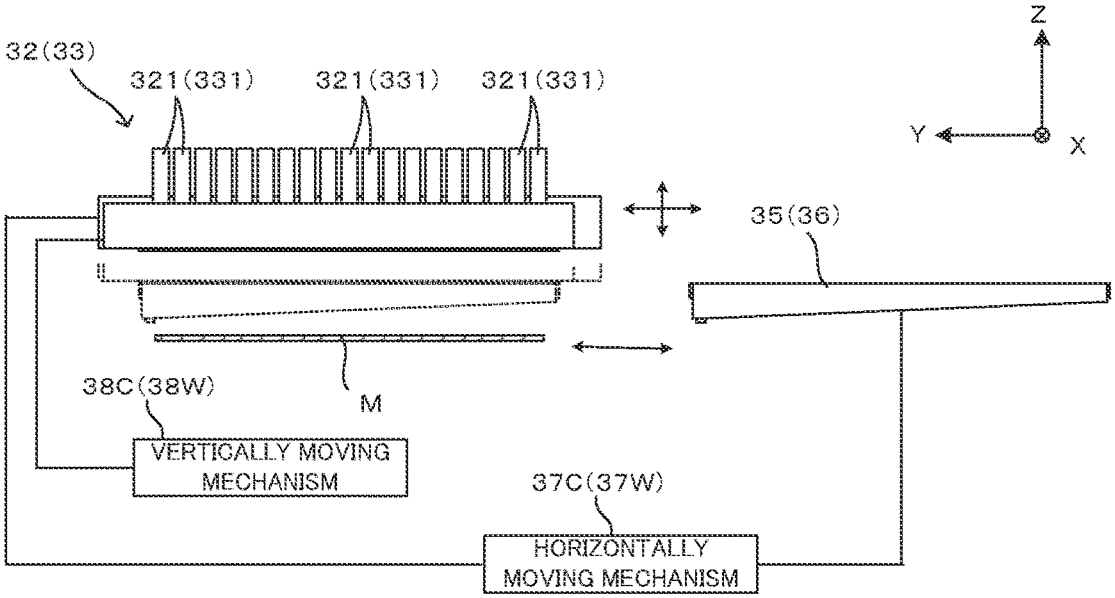
FIG. 2 is a diagram showing the configurations of the horizontally moving mechanism as one embodiment of the moving device according to the invention and the printer and the maintenance part to be conveyed by the horizontally moving mechanism.

Next, the configuration and operation of the horizontally moving mechanisms are described. FIG. 2 is a schematic diagram of a part of the printing apparatus when viewed from the (−X) direction. The printing apparatus 3 includes a horizontally moving mechanism 37C for alternatively moving the color printer 32 and the color maintenance part in the horizontal direction Y, a horizontally moving mechanism 37W for alternatively moving the white printer 33 and the white maintenance part in the horizontal direction Y, a vertically moving mechanism 38C for moving the discharge heads 321 perpendicularly to the surface M1 of the printing medium M, and a vertically moving mechanism 38W for moving the discharge heads 331 perpendicularly to the surface M1 of the printing medium M. Out of these, the vertically moving mechanisms 38C, 38W respectively adjust gaps between the nozzle surfaces of the discharge heads 321, 331 and the surface M1 of the printing medium M.

The moving mechanisms 37C, 37W basically have a similar configuration except the numbers and shapes of the discharge heads and the maintenance parts to be moved. Accordingly, the following description is centered on examples of the configuration and operation of the horizontally moving mechanism 37C, and those of the horizontally moving mechanism 37W are not described with the components thereof denoted by the same or equivalent reference signs.

Figure 3:
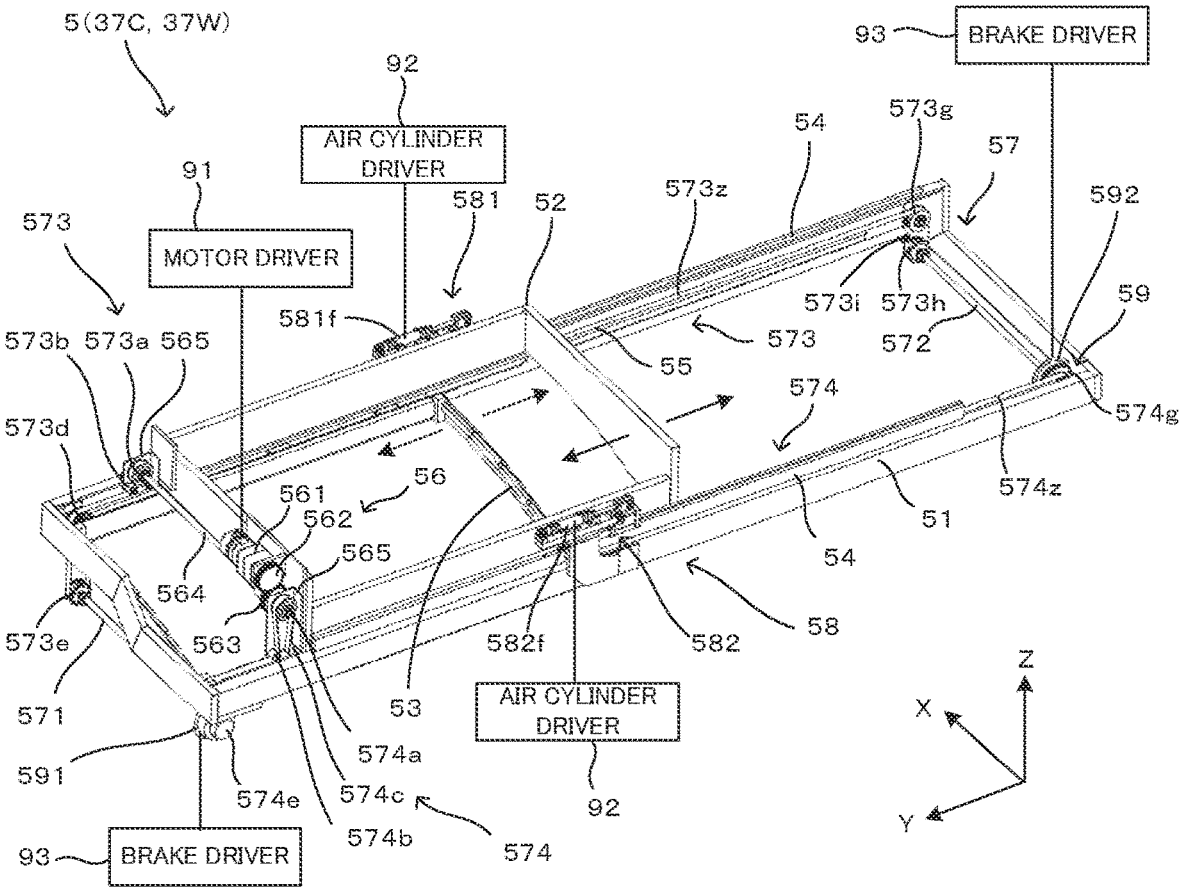
FIG. 3 is a diagram showing the configuration of the horizontally moving mechanism.
Figure 4:
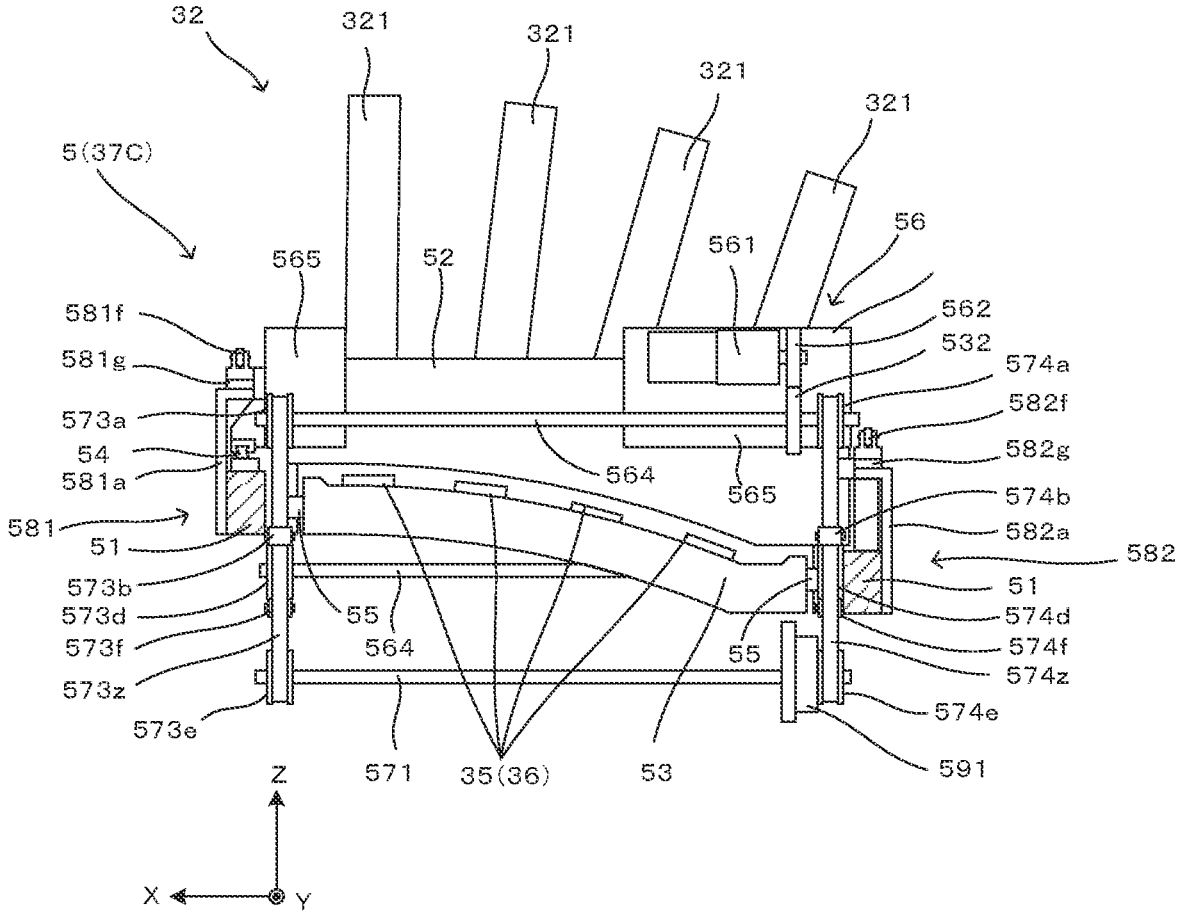
FIG. 4 is a partial sectional view of the horizontally moving mechanism shown in FIG. 3 when viewed from the Y direction.

FIG. 2 is a diagram showing the configurations of the horizontally moving mechanism as one embodiment of the moving device according to the invention and the printer and the maintenance part to be conveyed by the horizontally moving mechanism. FIG. 3 is a diagram showing the configuration of the horizontally moving mechanism. FIG. 4 is a partial sectional view of the horizontally moving mechanism shown in FIG. 3 when viewed from the Y direction. Note that a horizontally moving mechanism 5, which is an example of the horizontally moving mechanism 37C, is shown in FIG. 3 with the discharge heads 321 and the color maintenance part 35 removed to clearly show the structure of the horizontally moving mechanism 5.

The horizontally moving mechanism 5 includes a body frame 51, a head mounting frame 52 for mounting a plurality of the discharge heads 321 constituting the color printer 32, and a maintenance mounting frame 53 for mounting the color maintenance part 35. As shown in FIG. 3, the body frame 51 has a frame shape extending in the Y direction in a plan view from vertically above, and is open vertically upward and downward. In the Y direction, the body frame 51 extends longer than the sum of a length of the head mounting frame 52 and that of the maintenance mounting frame 53. Head guide rails 54, 54 extending in the Y direction are respectively mounted on upper end surfaces of (+X) and (−X) sides of the upper surface of this body frame 51. As shown by solid-line arrows in FIG. 3, the head mounting frame 52 is provided movably in the Y direction along these head guide rails 54, 54. Further, maintenance guide rails 55, 55 extending in the Y direction are respectively mounted on inner side surfaces of (+X) and (−X) sides of the body frame 51. As shown by dotted-line arrows in FIG. 3, the maintenance mounting frame 53 is provided movably in the Y direction along these maintenance guide rails 55, 55 below the head mounting frame 52.

A horizontal driving unit 56 for driving the head mounting frame 52 and the maintenance mounting frame 53 is mounted on an outer side surface on a (+Y) side of the head mounting frame 52. The horizontal driving unit 56 includes a motor 561, a drive gear 562 mounted on a rotary shaft of the motor 561, a driven gear 563 configured to rotate by being meshed with the drive gear 562, a rotary shaft 564 configured to rotate integrally with the driven gear 563 while extending in the X direction, and a pair of brackets 565, 565 pivotally supporting both end parts of the rotary shaft 564. The pair of these brackets 565 are coupled to the head mounting frame 52. Thus, if the motor 561 is operated by a motor driver 91 of the controller 9, the rotary shaft 564 rotates about an axis of rotation extending in the X direction. This rotational motion of the rotary shaft 564 is transmitted to a frame moving unit 57 to be described next. As a result, one of the head mounting frame 52 and the maintenance mounting frame 53 is alternatively moved in the Y direction by a distance corresponding to a rotation amount of the rotary shaft 564. Further, when the head mounting frame 52 is selectively moved in the Y direction, the horizontal driving unit 56 also moves in the Y direction integrally with the head mounting frame 52. On the other hand, as described in detail later, the movement of the horizontal driving unit 56 is restricted together with the movement of the head mounting frame 52 when the maintenance mounting frame 53 is selectively moved.

As shown in FIGS. 3 and 4, the frame moving unit 57 includes two rotary shafts 571, 572 extending in the X direction, a (+X) side frame mover 573 and a (−X) side frame mover 574. The rotary shaft 571 is provided rotatably with respect to a (+Y) side end part of the body frame 51 while extending in the X direction. Further, the rotary shaft 572 is provided rotatably with respect to a (−Y) side end part of the body frame 51 while extending in the X direction.

The (+X) side frame mover 573 includes a plurality of pulleys 573*a* to 573*i* arranged on a side closer to the (+X) side than the head mounting frame 52 and the maintenance mounting frame 53 and a belt 573*z*. In this embodiment, a toothed belt is used as the belt 573*z*. Further, toothed pulleys are accordingly used as the pulleys 573*a* to 573*i*. This point similarly applies also to the (−X) side frame mover 574.

The pulleys 573*a* to 573*i* are divided into three groups. The first group is composed of the pulleys 573*a* to 573*c* movable in the Y direction integrally with the head mounting frame 52. The second group is composed of the pulleys 573*d* to 573*f* fixedly arranged on a (+Y) side of the body frame 51. The third group is composed of the pulleys 573*g* to 573*i* fixedly arranged on a (−Y) side of the body frame 51. In particular, each group is configured as follows.

The pulley 573*a* is fixed to a (+X) side end part of the rotary shaft 564 and integrally rotates about an axis of the rotary shaft 564 together with the rotary shaft 564. Further, two pulleys 573*b*, 573*c* are arranged at positions below the pulley 573*a*, rotatably about axes of rotation parallel to the above axis. Note that these three pulleys 573*a* to 573*c* are rotatably pivotally supported on the bracket 565. Thus, when the horizontal driving unit 56 moves, the pulleys 573*a* to 573*c* move together with the head mounting frame 52 and the horizontal driving unit 56. On the contrary, when a movement of the head mounting frame 52 is restricted by a head restriction switcher 58 to be described later, movements of the pulleys 573*a* to 573*c* together with the head mounting frame 52 and the horizontal driving unit 56 are restricted.

On a side closer to the (+Y) side than the pulleys 573*a* to 573*c*, the pulleys 573*d*, 573*f* are mounted rotatably with respect to the (+Y) side end part of the body frame 51 as shown in FIGS. 3 and 4. Further, the pulley 573*e* is fixed to a (+X) side end part of the rotary shaft 571. That is, in this embodiment, the disposed positions of these three pulleys 573*d* to 573*f* are fixed on the (+Y) side of the body frame 51.

On a side closer to the (−Y) side than the pulleys 573*a* to 573*c*, the pulleys 573*g*, 573*i* are mounted rotatably with respect to the (−Y) side end part of the body frame 51 as shown in FIGS. 3 and 4. Further, the pulley 573*h* is fixed to a (+X) side end part of the rotary shaft 572. That is, in this embodiment, the disposed positions of these three pulleys 573*g* to 573*i* are fixed on the (−Y) side of the body frame 51.

One and the other ends of the belt 573*z* are respectively fixed to (+Y) and (−Y) side end parts of the maintenance mounting frame 53 by a belt fixing member not shown in FIGS. 3 and 4. Further, an intermediate part of the belt 573*z* is successively laid on the pulleys 573*f*, 573*e*, 573*d*, 573*b*, 573*a*, 573*c*, 573*i*, 573*h* and 573*g* from one end to the other end.

The (−X) side frame mover 574 is configured similarly to the (+X) side frame mover 573 except not including pulleys equivalent to the pulleys 573*g*, 573*h*. That is, the (−X) side frame mover 574 includes a plurality of pulleys 574*a* to 574*g* arranged on a side closer to the (−X) side than the head mounting frame 52 and the maintenance mounting frame 53 and a belt 574*z*. The pulleys 574*a* to 574*g* are divided into three groups. The first group is composed of the pulleys 574*a* to 574*c* movable in the Y direction integrally with the head mounting frame 52. The second group is composed of the pulleys 574*d* to 574*f* fixedly arranged on the (+Y) side of the body frame 51. The third group is composed of the pulley 574*g* fixedly arranged on the (−Y) side of the body frame 51. In particular, each group is configured as follows.

The pulley 574*a* is fixed to a (−X) side end part of the rotary shaft 564 and integrally rotates about the axis of the rotary shaft 564 together with the rotary shaft 564. Further, two pulleys 574*b*, 574*c* are arranged at positions below the pulley 574*a*, rotatably about axes of rotation parallel to the above axis. Note that these three pulleys 574*a* to 574*c* are rotatably pivotally supported on the bracket 565. Thus, when the horizontal driving unit 56 moves, the pulleys 574*a* to 574*c* move together with the head mounting frame 52 and the horizontal driving unit 56. On the contrary, when a movement of the head mounting frame 52 is restricted by the head restriction switcher 58 to be described later, movements of the pulleys 574*a* to 574*c* together with the head mounting frame 52 and the horizontal driving unit 56 are restricted.

On a side closer to the (+Y) side than the pulleys 574*a* to 574*c*, the pulleys 574*d*, 574*f* are mounted rotatably with respect to the (+Y) side end part of the body frame 51 as shown in FIGS. 3 and 4. Further, the pulley 574*e* is fixed to a (−X) side end part of the rotary shaft 571. That is, in this embodiment, the disposed positions of these three pulleys 574*d* to 574 are fixed on the (+Y) side of the body frame 51.

On a side closer to the (−Y) side than the pulleys 574*a* to 574*c*, the pulley 574*g* is mounted rotatably with respect to the (−Y) side end part of the body frame 51 as shown in FIGS. 3 and 4. That is, in this embodiment, the disposed position of the pulley 574*g* is fixed on the (−Y) side of the body frame 51.

One and the other ends of the belt 574*z* are respectively fixed to the (+Y) and (−Y) side end parts of the maintenance mounting frame 53 by a belt fixing member (574*y* in FIGS. 6A to 6C to be described later). Further, an intermediate part of the belt 574*z* is successively laid on the pulleys 574*f*, 574*e*, 574*d*, 574*b*, 574*a*, 574*c* and 574*g* from one end to the other end.

As described above, by providing the (+X) side frame mover 573 and the (−X) side frame mover 574, a rotational drive force generated by the motor 561 can be transmitted to the head mounting frame 52 and the maintenance mounting frame 53. However, it is impossible to alternatively move and position one of the head mounting frame 52 and the maintenance mounting frame 53 in the Y direction only by transmitting the rotational drive force via the (+X) side frame mover 573 and the (−X) side frame mover 574. Accordingly, in this embodiment, the head restriction switcher 58 and a belt restriction switcher 59 are provided.

Figure 5A:
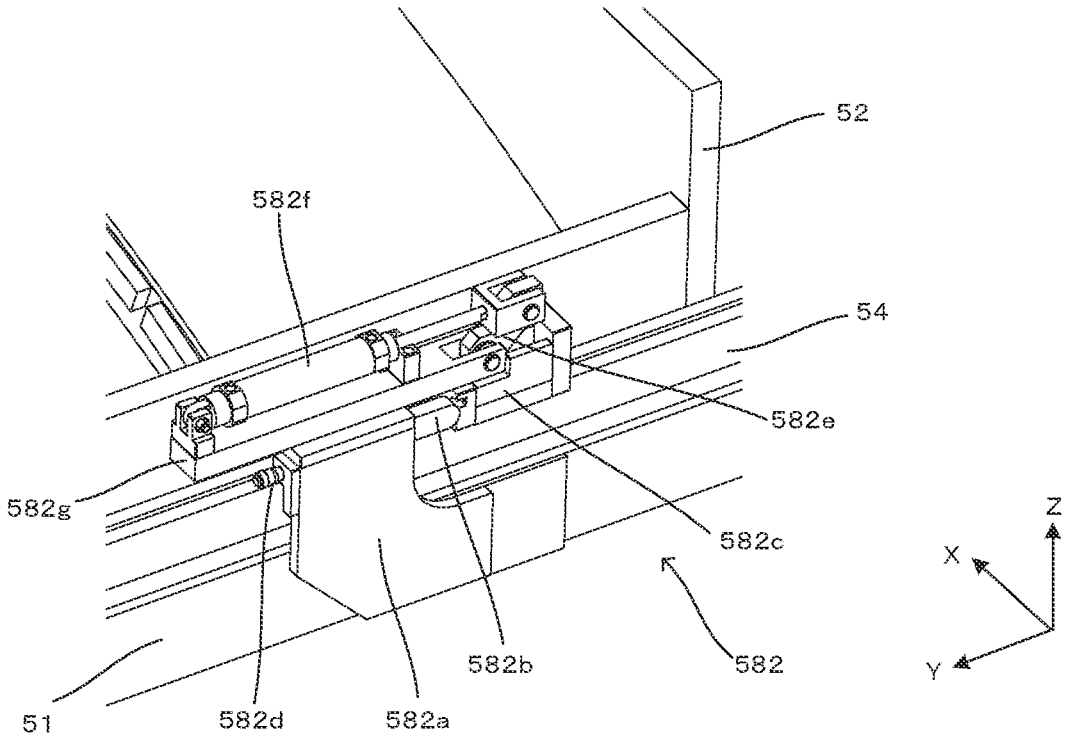
FIG. 5A is a diagram showing the head restriction switcher for switching the movement restriction of the head mounting frame.
Figure 5B:
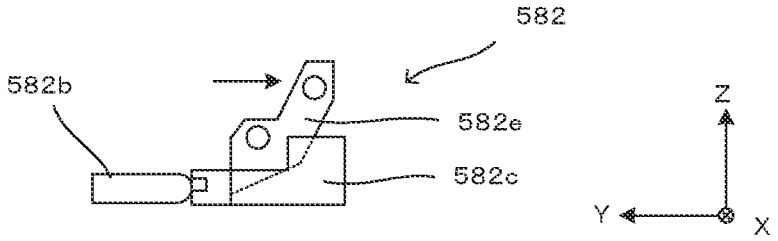
FIG. 5B is a schematic diagram showing an operation during the movement restriction by the head restriction switcher of FIG. 5A.
Figure 5C:
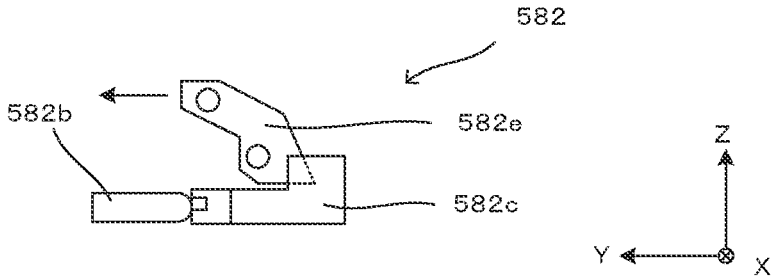
FIG. 5C is a schematic diagram showing an operation when the movement restriction by the head restriction switcher of FIG. 5A is released.

FIG. 5A is a diagram showing the head restriction switcher for switching the movement restriction of the head mounting frame. FIG. 5B is a schematic diagram showing an operation during the movement restriction by the head restriction switcher of FIG. 5A. FIG. 5C is a schematic diagram showing an operation when the movement restriction by the head restriction switcher of FIG. 5A is released. The head restriction switcher 58 includes two restriction switching units 581, 582 as shown in FIGS. 3 and 4. Out of these, the restriction switching unit 582 includes a bracket 582*a* as shown in FIG. 5A. A lower end part of the bracket 582*a* is fixed to the body frame 51. On the other hand, an upper end part of the bracket 582*a* extends further upward than the body frame 51. A body-side engaging member 582*b* is mounted on the upper end part of the bracket 582*a* to be movable by a certain amount in the Y direction. This body-side engaging member 582*b* is so mounted that a tip part thereof projects in the (−Y) direction from the upper end part of the bracket 582*a*. This tip part can latch a head positioning member 582*c* fixed to an outer side surface on a (−X) side of the head mounting frame 52 as shown in FIGS. 5A to 5C. By this latching, the discharge heads 321 mounted in the head mounting frame 52 are positioned at the printing position in the Y direction. Note that a printing position adjustment screw 582*d* is provided to adjust this printing position in this embodiment. This printing position adjustment screw 582*d* is mounted to project and retract in the Y direction with respect to the upper end part of the bracket 582*a*. By a projecting/retracting movement of the printing position adjustment screw 582*d* by an operator, the printing position adjustment screw 582*d* acts on a rear end part (end part on +Y side) of the body-side engaging member 582*b*, whereby a projection amount of the tip part in the Y direction can be changed. By changing this projection amount, the printing position of the discharge heads 321 in the Y direction can be adjusted.

Further, the head positioning member 582*c* has not only a function of positioning the discharge heads 321, but also a function as a head-side engaging member to be engaged with the body-side engaging member 582*b* and a body-side engaging member 582*e* to be described next. That is, the body-side engaging member 582*e* and an air cylinder 582*f* are provided to fix the head mounting frame 52 and restrict a movement of the head mounting frame 52 at the printing position. A cylinder part of the air cylinder 582*f* is fixed to the upper surface of the bracket 582*a* via a support plate 582*g*. A piston part of the air cylinder 582*f* can extend in the (−Y) direction and retract in the (+Y) direction above this support plate 582*g*. One end part of the body-side engaging member 582*e* is coupled to a tip part of this piston part. Further, a central part of the body-side engaging member 582*e* is swingably pivotally supported on the support plate 582*g* as shown in FIGS. 5B and 5C. Thus, if the piston part of the air cylinder 582*f* extends in the (−Y) direction in response to an extension command from an air cylinder driver 92 of the controller 9, the body-side engaging member 582*e* swings in a clockwise direction about the above pivotally supporting position as a swing center as shown in FIG. 5B. In this way, the other end part of the body-side engaging member 582*e* moves toward the head positioning member 582*c* to be engaged with the head engaging member 582*c*. That is, a part of the head positioning member 582*c* is sandwiched by two body-side engaging members 582*b*, 582*e* in the Y direction. As a result, a movement of the head mounting frame 52 is restricted even when the motor 561 is operating.

On the other hand, if the piston part of the air cylinder 582*f* retracts in the (+Y) direction in response to a retraction command from the air cylinder driver 92 of the controller 9, the body-side engaging member 582*e* swings in a counter-clockwise direction about the above pivotally supporting position as a swing center as shown in FIG. 5C. In this way, the other end part of the body-side engaging member 582*e* is separated from the head positioning member 582*c* to be disengaged from the head engaging member 582*c*. That is, the part of the head positioning member 582*c* and the body-side engaging member 582*e* are disengaged in the Y direction. By this disengagement, the movement restriction of the head mounting frame 52 is released. As a result, the discharge heads 321 can be positioned at the retracted position by a movement of the head mounting frame 52 in the (−Y) direction from the printing position.

Next, the belt restriction switcher 59 is described. The belt restriction switcher 59 is composed of two electromagnetic brakes 591, 592. One electromagnetic brake is arranged near the pulley 574*e*. The other electromagnetic brake is arranged near the pulley 574*g*. If a braking command is output from a brake driver 93 of the controller 9, the both electromagnetic brakes respectively exert braking forces to the pulleys 574*e*, 574*g*. As a result, movements of the belts 573*z*, 574*z* are restricted even when the motor 561 is operating.

On the other hand, if the output of the braking command from the brake driver 93 is stopped, the exertion of the braking forces to the pulleys 574*e*, 574*g* by the electromagnetic brakes is stopped. As a result, the movement restriction of the belts 573*z*, 574*z* is released and the maintenance mounting frame 53 can be moved in the Y direction by belt movements.

Figure 6A:
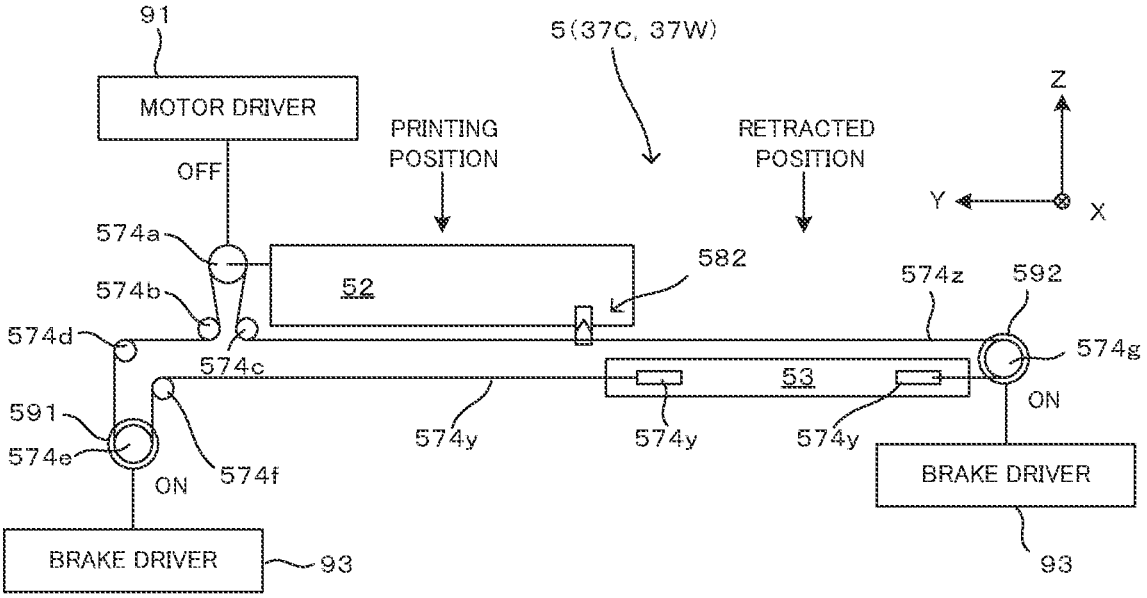
FIGS. 6A to 6C are diagrams schematically showing the operation of the printing apparatus.
Figure 6B:
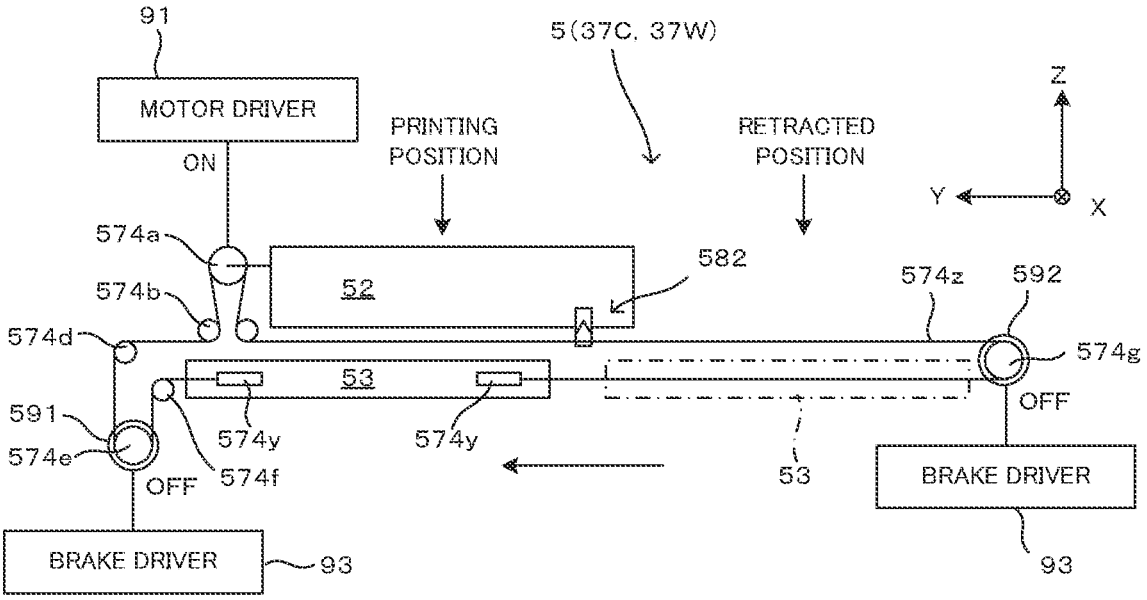
Figure 6C:
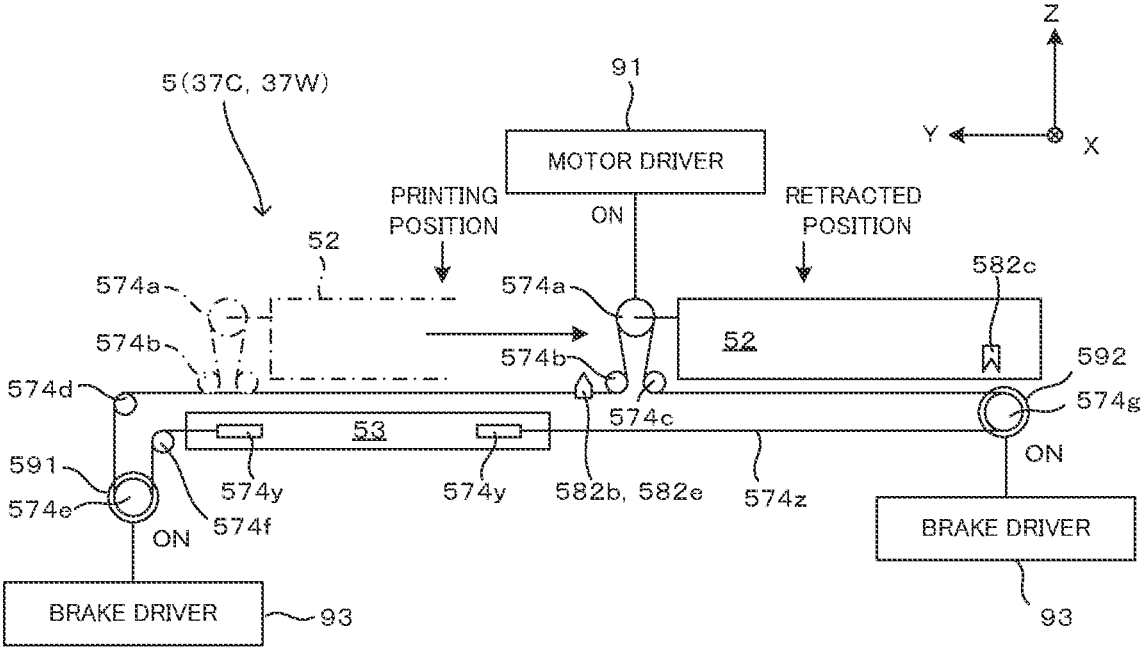

FIGS. 6A to 6C are diagrams schematically showing the operation of the printing apparatus. FIG. 6A shows the operation of the horizontally moving mechanism 5 when a normal printing process is performed by the printing apparatus 3 configured as described above (printing mode). FIG. 6B shows the operation of the horizontally moving mechanism 5 when maintenance is performed for the discharge heads 321, 331 having performed the printing process by the maintenance part 35 (maintenance movement mode). FIG. 6C shows the operation of the horizontally moving mechanism 5 when a nozzle surface operation is performed at the retracted position by the operator (head movement mode). Each mode is described below with reference to the drawings. Although the color printer 32 and the white printer 33 differ in the type and number of the discharge heads, the operation of the horizontally moving mechanism 5 is basically the same. Accordingly, the operation of the horizontally moving mechanism 5 in the color printer 32 is described and the operation of the horizontally moving mechanism 5 (37C) in the white printer 33 is not described below.

The printing process in the color printer 32 is performed with the head mounting frame 52 mounting the discharge heads 321 positioned at the printing position as shown in FIG. 6A. That is, on the (−X) side, a movement of the head mounting frame 52 in the Y direction is restricted by the restriction switching unit 582 as shown in FIG. 6A. Further, although not shown in FIG. 6A, the movement of the head mounting frame 52 in the Y direction is restricted by the restriction switching unit 581 also on the (+X) side. In this way, displacements of the discharge heads 321 from the printing position set in advance is reliably prevented by the movement restriction of the head mounting frame 52 by the two restriction switching units 581, 582. Moreover, the drive of the motor 561 (see FIGS. 3 and 4) by the motor driver 91 is stopped and movements of the belts 573*z*, 574*z* are restricted by the operation of the electromagnetic brakes 591, 592. As a result, the printing process can be stably and satisfactorily performed. Note that the maintenance mounting frame 53 mounting the color maintenance part 35 is positioned and waits at the retracted position separated from the printing position in the (−Y) direction while the printing process is performed.

Further, a maintenance process may be performed for the discharge heads 321 after a certain amount of the printing process is performed. Accordingly, in this embodiment, the maintenance mounting frame 53 is alternatively moved in the (+Y) direction by the horizontally moving mechanism 5 with the discharge heads 321 positioned at the printing position. More specifically, as shown in FIG. 6B, the output of the braking command from the brake driver 93 is stopped with the movement restriction of the head mounting frame 52 by the restriction switching units 581, 582 continued. In this way, the movement restriction of the belts 573*z*, 574*z* by the electromagnetic brakes 591, 592 is released. Simultaneously with this or after the above release of the movement restriction, the motor 561 is driven by the motor driver 91. Here, movements of the head mounting frame 52 and the horizontal driving unit 56 remain to be restricted, whereas the movement restriction of the belts 573*z*, 574*z* is released. Thus, the belts 573*z*, 574*z* move among the plurality of pulleys clockwise on the plane of FIG. 6B by a distance corresponding to a rotation amount of the rotary shaft of the motor 561. As a result, as indicated by a solid-line arrow in FIG. 6B, the maintenance mounting frame 53 moves from the retracted position to the printing position to locate the color maintenance part 35 below the discharge heads 321. After the movement is completed, the maintenance process is performed.

It may become necessary for the operator to directly access the nozzle surfaces of the discharge heads 321 for an operation. Accordingly, in this embodiment, if a command indicating that operation is given to the controller 9 from the operator, the controller 9 causes the horizontally moving mechanism 5 to alternatively move the head mounting frame 52 in the (−Y) direction while keeping the maintenance mounting frame 53 mounting the color maintenance part 35 at the printing position. More specifically, as shown in FIG. 6C, a braking command is output from the brake driver 93 and movements of the belts 573*z*, 574*z* are restricted. On the other hand, the body-side engaging member 582*e* and the head positioning member 582*c* are disengaged to release the movement restriction of the head mounting frame 52 in response to a retraction command from the air cylinder driver 92. Simultaneously with this or after the above release of the movement restriction, the motor 561 is driven by the motor driver 91. Here, movements of the belts 573*z*, 574*z* remain to be restricted, whereas the movement restriction of the head mounting frame 52 and the horizontal driving unit 56 is released. Thus, the head mounting frame 52 and the horizontal driving unit 56 move in the (−Y) direction by a distance corresponding to a rotation amount of the rotary shaft of the motor 561. As a result, as shown by a solid-line arrow in FIG. 6C, the head mounting frame 52 and the horizontally moving mechanism 56 move from the printing position to the retracted position, whereby the discharge heads 321 mounted in the head mounting frame 52 become accessible. After the movements are completed, the operation is performed by the operator.

As described above, in this embodiment, the head movement mode and the maintenance movement mode can be alternatively performed by combining the movement restriction and movement restriction release of the belts 573*z*, 574*z* and the movement restriction release and the movement restriction of the head mounting frame 52 when the motor 561 is driven. That is, the head mounting frame 52 and the maintenance mounting frame 53 can be alternatively moved in the Y direction by the single motor 561 and the configuration of the apparatus can be simplified.

Further, in the above embodiment, a rotational drive force of the motor 561 is transmitted to the (−X) side frame mover 574 to alternatively give a movement propulsion force to the head mounting frame 52 and the maintenance mounting frame 53 on the (−X) side as shown in FIG. 3. Moreover, the rotational drive force is transmitted also to the (+X) side frame mover 573 via the rotary shaft 564 to alternatively give a movement propulsion force to the head mounting frame 52 and the maintenance mounting frame 53 also on the (+X) side. Of course, the rotational drive force may be given only to one of the (+X) and (−X) sides, but movements of the head mounting frame 52 and the maintenance mounting frame 53 in the Y direction can be stabilized by transmitting the rotational driven force to both sides as in the above embodiment.

Further, in the above embodiment, the belt restriction switcher 59 includes the electromagnetic brakes 591, 592 as examples of a "brake member" of the invention as shown in FIGS. 3 and 6A to 6C. That is, a braking force is caused to act on both the (+Y) side and the (−Y) side. Of course, an electromagnetic brake may be configured to act only on one of the (+Y) and (−Y) sides, but movements of the belts 573*z*, 574*z* can be more stably restricted by causing the braking forces to act on both sides as in the above embodiment.

Further, in this embodiment, the body-side engaging member 582*b* has both the function of positioning the head mounting frame 52 at the printing position and the function of restricting the movement of the head mounting frame 52 in cooperation with the other body-side engaging member 582*e*. Of course, a member in charge of the above positioning function may be separately provided, but apparatus cost and size can be reduced by suppressing the number of components by providing the body-side engaging member 582*b* having two functions as in the above embodiment.

As described above, in this embodiment, the X and Y directions respectively correspond to examples of a "first direction" and a "second direction" of the invention. On the (+X) side, the pulleys 573*d*, 573*e* correspond to an example of a "first body-side rotating member" of the invention, the pulley 573*a* corresponds to an example of a "head-side rotating member" of the invention, the pulleys 573*g* to 573*i* correspond to an example of a "second body-side rotating member" of the invention, and the belt 573*z* corresponds to an example of a "cord" of the invention. Further, on the (−X) side, the pulleys 574*d*, 574*e* correspond to an example of the "first body-side rotating member" of the invention, the pulley 574*a* corresponds to an example of the "head-side rotating member" of the invention, the pulley 574*g* corresponds to an example of the "second body-side rotating member" of the invention, and the belt 574*z* corresponds to an example of the "cord" of the invention. Further, the belt restriction switcher 59 corresponds to an example of a "cord restriction switcher" of the invention. Further, the air cylinders 581*f*, 582*f* correspond to examples of an "engagement switching member" of the invention.

Note that the invention is not limited to the embodiment described above and various changes other than the aforementioned ones can be made without departing from the gist of the invention. For example, although the toothed belt is used as the "cord" of the invention in the above embodiment, another belt such as a flat belt or V belt may be used. Further, a wire or the like may be used as the "cord" of the invention.

Further, although the engagement is switched by the air cylinders 581*f*, 582*f* in the above embodiment, another actuator such as a motor may be used as the "engagement switching member" of the invention.

Further, although the "moving device" according to the invention is applied to both the color printer 32 and the white printer 33 in the above embodiment, the "moving device" according to the invention may be applied to only one printer. Further, although the invention is applied to the printing apparatus 3 equipped with both the color printer 32 and the white printer 33 in the above embodiment, the invention can be applied also to a printing apparatus having only one printer and, further, a printing apparatus additionally equipped with a printer for printing other inks.

This invention can be applied to moving techniques in general for alternatively moving a discharge head for printing by discharging an ink and a maintenance part for performing the maintenance of the discharge head.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A moving device for alternatively moving a discharge head for printing by discharging an ink to a printing medium and a maintenance part for performing maintenance of the discharge head, the printing medium being conveyed in a first horizontal direction, the discharge head and the maintenance head being alternatively moved along a second horizontal direction differing from the first horizontal direction, the moving device comprising:

a body frame;

a first body-side rotating member and a second body-side rotating member mounted rotatably on the body frame while the first body-side rotating member and the second body-side rotating member being separated from each other in the second horizontal direction;

a head mounting frame provided movably between the first body-side rotating member and the second body-side rotating member in the second horizontal direction while the discharge head is mounted onto the head mounting frame;

a maintenance mounting frame provided below the head mounting frame and movably between the first body-side rotating member and the second body-side rotating member in the second horizontal direction while the maintenance part is mounted onto the maintenance mounting frame;

a single motor coupled to the head mounting frame;

a head-side rotating member provided rotatably on the head mounting frame, wherein the head-side rotating member rotates by receiving a drive force from the single motor;

a cord having i) a first end fixed to a first part of the maintenance mounting frame and ii) a second end fixed to a second part of the maintenance mounting frame, the cord extending from the first part of the maintenance mounting frame through the first body-side rotating member, the head-side rotating member, and the second body-side rotating member to the second part of the maintenance mounting frame;

a cord restriction switcher configured to switch between i) restricting a movement of the cord and ii) allowing the movement of the cord; and a head restriction switcher configured to switch between i) restricting a movement of the head mounting frame and ii) allowing the movement of the head mounting frame, wherein when the cord restriction switcher allows the movement of the cord and the head restriction switcher restricts the movement of the head mounting frame, the maintenance mounting frame moves together with the maintenance part using the drive force of the single motor while the head mounting frame does not move, and when the cord restriction switcher restricts the movement of the cord and the head restriction switcher allows the movement of the head mounting frame, the head mounting frame moves together with the discharge head using the drive force of the single motor while the maintenance mounting frame does not move.

2. The moving device according to claim 1, wherein the head restriction switcher restricts the movement of the head mounting frame at a printing position where printing on the printing medium is performed by the discharge head.

3. The moving device according to claim 2, wherein the head restriction switcher continues to restrict the movement of the head mounting frame at the printing position while printing on the printing medium is being performed by the discharge head.

4. The moving device according to claim 2, wherein the head restriction switcher includes a body-side engaging member mounted on the body frame, a head-side engaging member mounted on the head mounting frame and an engagement switching member configured to switch between i) engaging the body-side engaging member and the head-side engaging member and ii) disengaging the body-side engaging member and the head-side engaging member.

5. The moving device according to claim 2, wherein the drive force of the single motor moves the maintenance mounting frame together with the maintenance part to the printing position and position the maintenance part below the discharge head while the movement of the head mounting frame is restricted at the printing position.

6. The moving device according to claim 2, wherein the drive force of the motor moves the head mounting frame together with the discharge head to a retracted position separated from the printing position in the second horizontal direction and form a space enabling access to the discharge head from below while the movement of the maintenance mounting frame is restricted at the printing position.

7. The moving device according to claim 1, wherein the cord restriction switcher includes a brake member coupled to at least one of the first body-side rotating member and the second body-side rotating member.

* * * * *